US006627815B1

(12) United States Patent
Ebersole

(10) Patent No.: US 6,627,815 B1
(45) Date of Patent: Sep. 30, 2003

(54) ALL-IN-ONE JUNCTION BOX FOR ELECTRICAL HOOK-UP OF FURNACES AND ANCILLARY FIXED APPLIANCES

(76) Inventor: Joel D. Ebersole, 10829 W. 70th Ave., Arvada, CO (US) 80004

( * ) Notice: Subject to any disclaimer, the term of this patent is extended or adjusted under 35 U.S.C. 154(b) by 0 days.

(21) Appl. No.: 10/266,058

(22) Filed: Oct. 7, 2002

(51) Int. Cl.[7] ..... H01H 13/04

(52) U.S. Cl. ..... 174/53; 339/219 F; 200/166 CT; 200/168 R; 337/256; 317/116

(58) Field of Search ..... 174/53; 200/166 CT, 200/168 R; 337/256; 339/219 F; 317/116

(56) References Cited

U.S. PATENT DOCUMENTS 3,833,052 A * 9/1974 Cardinal ..... 165/228
4,818,475 A * 4/1989 Gluntz et al. ..... 376/282
4,947,278 A * 8/1990 Nichols, III ..... 361/46
5,574,612 A * 11/1996 Pak ..... 361/93.1
6,252,764 B1 * 6/2001 Benson ..... 361/625

* cited by examiner

*Primary Examiner*—Dean A. Reichard
*Assistant Examiner*—Anton Harris
(74) *Attorney, Agent, or Firm*—Kent A. Lembke; Hogan & Hartson LLP

(57) ABSTRACT

A junction box for electrically connecting a furnace to a service panel and providing power and control signals to fixed appliances. The junction box includes a panel connection adapted for connecting with the hot wire, the neutral wire, and the ground from the panel. A furnace connection is provided for connecting with a hot wire, a neutral wire, a ground, and a number of control wires from the furnace. A fuse and a disconnect switch are mounted in the junction box and wired in series between the hot wire connection of the panel connection and the hot wire connection of the furnace connection. A condensate pump outlet is wired to the hot wire connection portion of the panel connection on the line side of the disconnect switch. Humidifier and air cleaner outlets are coupled to the connections of the furnace connection used for control wires from the furnace.

13 Claims, 4 Drawing Sheets

ALL-IN-ONE JUNCTION BOX FOR ELECTRICAL HOOK-UP OF FURNACES AND ANCILLARY FIXED APPLIANCES

BACKGROUND OF THE INVENTION

1. Field of the Invention

The present invention relates, in general, to residential electrical and control systems, and more particularly, to an electrical junction box for use in providing an all-in-one box containing a fixed electrical circuit or component wiring and electrical components to facilitate connection of a forced-air furnace to a residential power source such as a service panel and connection of one or more heating and ventilation appliances often installed as part of a residential heating, ventilation, and air conditioning (HVAC) system to the service panel and/or to the furnace electrical system.

2. Relevant Background

A large percentage of homes and residential buildings in cooler climates use forced-air heating systems including a furnace with a blower to circulate heated air. The furnace is powered by electricity provided by a power source in the building or home such as from connection with a service panel. Often, a number of other heating, ventilation, and air conditioning components operate in conjunction with the furnace to condition air circulated throughout the residence. For example, an electronic air cleaner (EAC) may be provided to remove particulates in circulated air. A humidifier may also be included in the residential HVAC system to control humidity levels inside the building served by the HVAC system. Additionally, condensate pumps are often provided to remove water that condenses (often in an air conditioner) to prevent flooding near the furnace. Often, these additional appliances associated with the furnace are called fixed or ancillary appliances.

The ancillary appliances are typically powered by a connection to the service panel with their operations being directly or indirectly linked to the operation of the furnace. Many furnaces include an electrical junction box for connecting to the service panel and also providing control wires or connection points for fixed appliances that need to operate in conjunction with the furnace. For example, control wires may be provided for tying operation of a furnace blower motor with operation of an electric air cleaner (EAC) and/or a humidifier. The wiring and configuration of the HVAC and associated equipment and fixed appliances must be completed to applicable local codes or laws. In the United States, the wiring needs to comply with the National Electrical Code (NEC) requirements for residential HVAC systems. An example of code requirements include the provision of a ground fault circuit interrupt (GFCI) receptacle within sight of the furnace for providing power to tools, such as tools used in installing a furnace or fixed appliances or performing maintenance. Another code requirement is that an overcurrent, short-circuit protection device and a switch (e.g., a 125V box cover unit for a plug fuse with a proper ampere rating) be provided as a disconnecting means between the service panel and these components for automatically and selectively interrupting power to the furnace and to particular fixed appliances.

Wiring of residential HVAC systems at initial installation and during an upgrade or repair of the system can be a time consuming, and therefore, expensive task. Additionally, wiring the HVAC system correctly to appropriate codes and in a safe and effective manner is often difficult even for experienced electricians that may not be familiar with HVAC systems. During initial installation or installation of a replacement system, a standard furnace electrical hook up can take from one to four hours for an electrician depending upon the location of the furnace, the configuration of the furnace, and the number of ancillary appliances that are included in the HVAC system.

Presently, the furnace is wired to the service panel with an overcurrent protection device (e.g., a fuse) with a power switch wired between the furnace electrical junction box and the service panel. Then, each additional appliance and/or device is separately wired to the service box and/or to the overcurrent/disconnecting device and if appropriate, to the control wires provided in the furnace electrical junction box. This results in three or more boxes and a number of fittings being mounted near the furnace (such as on the return air duct near the furnace) and wiring running from each box to the various fixed appliances and to the furnace. The installing technician or electrician must assemble these boxes, fittings, and parts in a manner that meets national and local codes. Additionally, the furnace and appliance wiring must be done to manufacturers requirements and in a particular circuit configuration to assure proper operation. This is a time consuming process and mistakes can result in safety problems, flooding, product damage, or simply result in wasted power due to running appliances at incorrect times (such as by running the EAC or humidifier when the furnace blower motor is not running). Repairing or upgrading existing systems can also be time consuming with the electrician being forced to first understand an existing installation and wiring configuration and then installing new components to comply with codes and to be wired in the HVAC system to support proper operation of existing components as well as new components. A common upgrade is the addition of EACs or humidifiers, and these must be wired to the furnace controls to operate in conjunction with the furnace. Again, even experienced electricians find this to be a time-consuming process in which hurrying can result in unacceptable wiring mistakes and safety or operational problems.

Hence, there remains a need for a product or method for facilitating electrical wiring of HVAC systems including wiring furnaces, fixed appliances, and other components (such as overcurrent and switch units and GFCI receptacles) to residential power supplies such as service panels and to each other as required per national and local codes and for proper system and component operation.

SUMMARY OF THE INVENTION

The present invention addresses the above problems by providing an electrical hook-up junction box for furnaces and associated equipment that provides a single electrical connection to the furnace branch circuit of the service panel and easy and fast to wire connections to the furnace and receptacles for a number of fixed appliances. In one embodiment, the junction box is configured with an incoming power terminal block, an outgoing power terminal block, and a ground bar for providing convenient connections. For example, the incoming power terminal block is connected to the hot and neutral of the branch circuit from the service panel and the ground bar is connected to the ground from the branch circuit. Preferably, the blocks or strips and ground bar are labeled for proper hook up and when installed, the furnace is provided power by connection to the outgoing power terminal block and ground bar. A switch and fuse unit is connected to the terminals and ground bar to provide overcurrent or overload protection to the furnace and to allow power to be manually disconnected. Receptacles are provided for fixed appliances, such as a condensate pump, an EAC, and a humidifier with connections provided between the incoming and outgoing power terminal strips and ground bar and the receptacles to insure proper operation.

Control wires are also provided to connect the control terminals of the furnace electrical junction box and receptacles for the EAC and the humidifier such that these receptacles are only operable or hot when the blower motor is operating. Further, a GFCI outlet (such as one with two receptacles) is provided upstream of the switch and fuse unit to be available when power is needed to work on the system. The condensate receptacle is wired in the junction box upstream of the switch to provide uninterrupted power to the condensate pump when it is plugged into the receptacle. In this manner, the junction box of the invention provides an all-in-one electrical hook up box for use with most forced-air furnaces that significantly simplifies initial installation and repair of the furnace and associated appliances and devices by providing a self-contained, pre-configured power supply and control circuit and connection terminals and ports.

More particularly, an electrical junction box is provided for use in electrically hooking up a forced-air furnace and providing power and control signals to associated fixed appliances whether installed with the furnace or at a later time. The junction box includes a panel connection adapted for connecting to a cable from a service panel or other power source, e.g., connecting with the hot wire, the neutral wire, and the ground from the panel. A furnace connection is also provided for ready connection of a furnace cable typically including a hot wire, a neutral wire, a ground, and a number of control wires (such as a humidifier control wire and an EAC control wire). The connections may include a number of well-labeled terminals on an incoming power terminal strip, an outgoing power terminal strip, and a ground bar mounted within the junction box. A disconnect switch is mounted in the junction box and wired in series between the hot wire connection portion of the panel connection and the hot wire connection of the furnace connection and is manually operable to selectively interrupt electricity flow from the service panel connection to the furnace. A GFCI device with one or more receptacles is mounted within the junction box and wired to the hot wire connection portion of the panel connection on a line side of the disconnect switch. A condensate pump outlet with a receptacle is also mounted in the junction box and wired to the hot wire connection portion of the panel connection on the line side of the disconnect switch to allow a pump plugged into the receptacle to operate regardless of the position of the disconnect switch. A humidifier outlet and an EAC outlet both with receptacles are also mounted in the junction box and are coupled directly or indirectly (such as via a connector or node and a conductor) to the connections of the furnace connection used for the corresponding control wires from the furnace.

DETAILED DESCRIPTION OF THE PREFERRED EMBODIMENTS

The present invention is directed to an all-in-one electrical junction box, and HVAC systems using such a box, for use in facilitating wiring a furnace and associated fixed appliances and electrical devices in a manner that complies with national and local wiring and safety codes (such as the NEC in the United States) and that significantly reduces the amount of time, for completing initial wiring and for completing maintenance on or upgrades of the furnace, fixed appliances, and/or associated electrical devices. The junction box of the invention is configured such that electrical connection points are provided for connecting the box to a power source, e.g., a service panel in most residential buildings, and to a typical furnace electrical junction box. The connection to the furnace includes power wires or conductors as well as control wires. The box includes an overcurrent or overload protection device with a disconnect switch wired between the service panel and the furnace.

Receptacles are provided for fixed appliances including a condensate pump that is wired upstream of the overcurrent device, switch, and the furnace to allow it to operate without regard to the furnace operations. Receptacles are preferably provided for a humidifier and an electronic air cleaner (EAC) and these are connected downstream in the junction box circuit of the overcurrent device and switch and are connected to the control wires of the furnace, i.e., are interconnected to the blower motor, to operate only when the furnace (specifically, the blower motor) are operating. A GFCI outlet (such as a single or double receptacle unit) is also provided in the junction box and is wired into the junction box circuit upstream of the overcurrent device and switch to allow tools to be plugged into the receptacles to be powered via the service panel for use in repairing or installing a furnace and/or fixed appliances.

Figure 1:
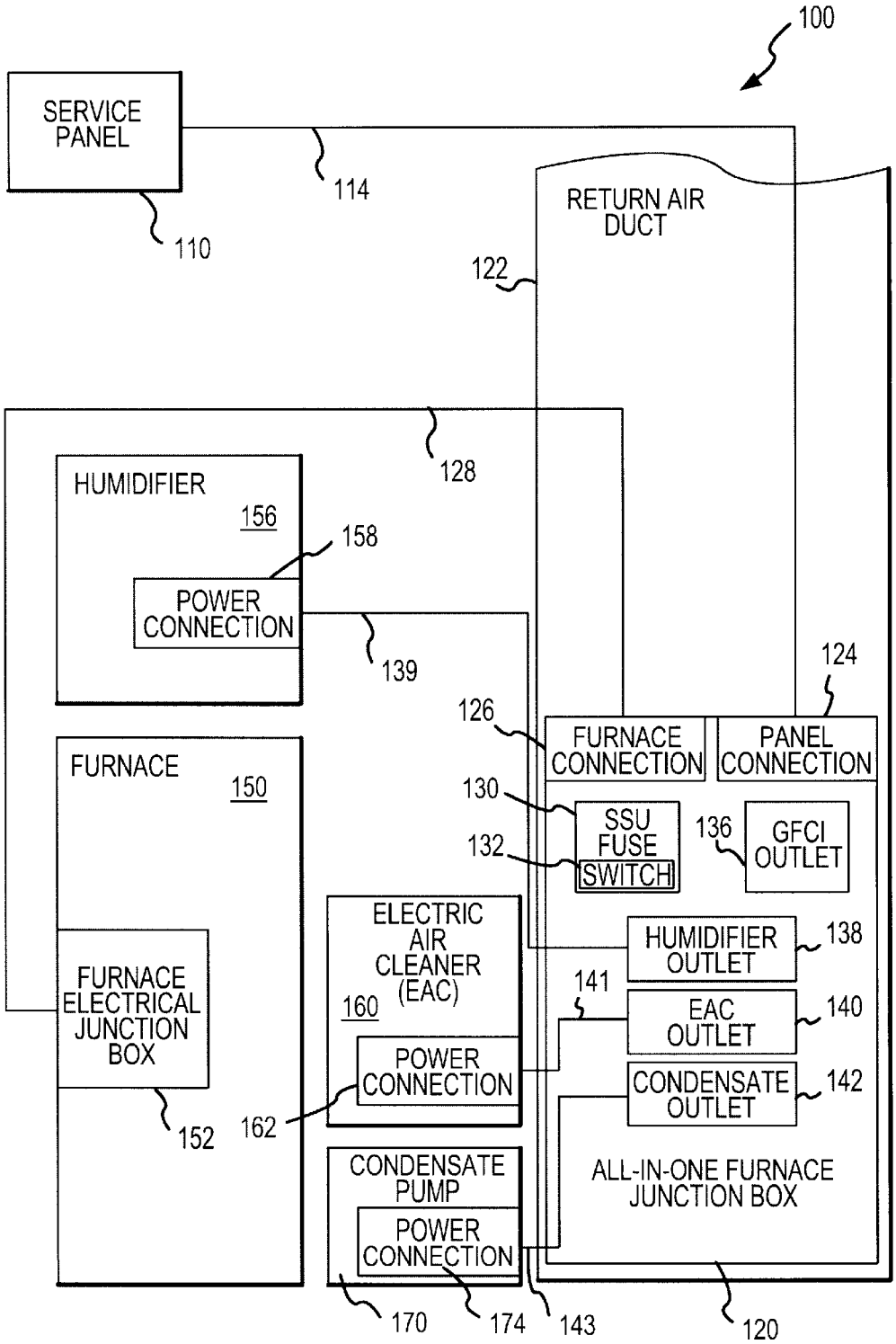
FIG. 1 illustrates in block diagram form a residential furnace system or HVAC system including the all-in-one furnace junction box of the invention for providing electrical connections between a service panel or power supply, a forced-air furnace, and associated fixed appliances.
Figure 2:
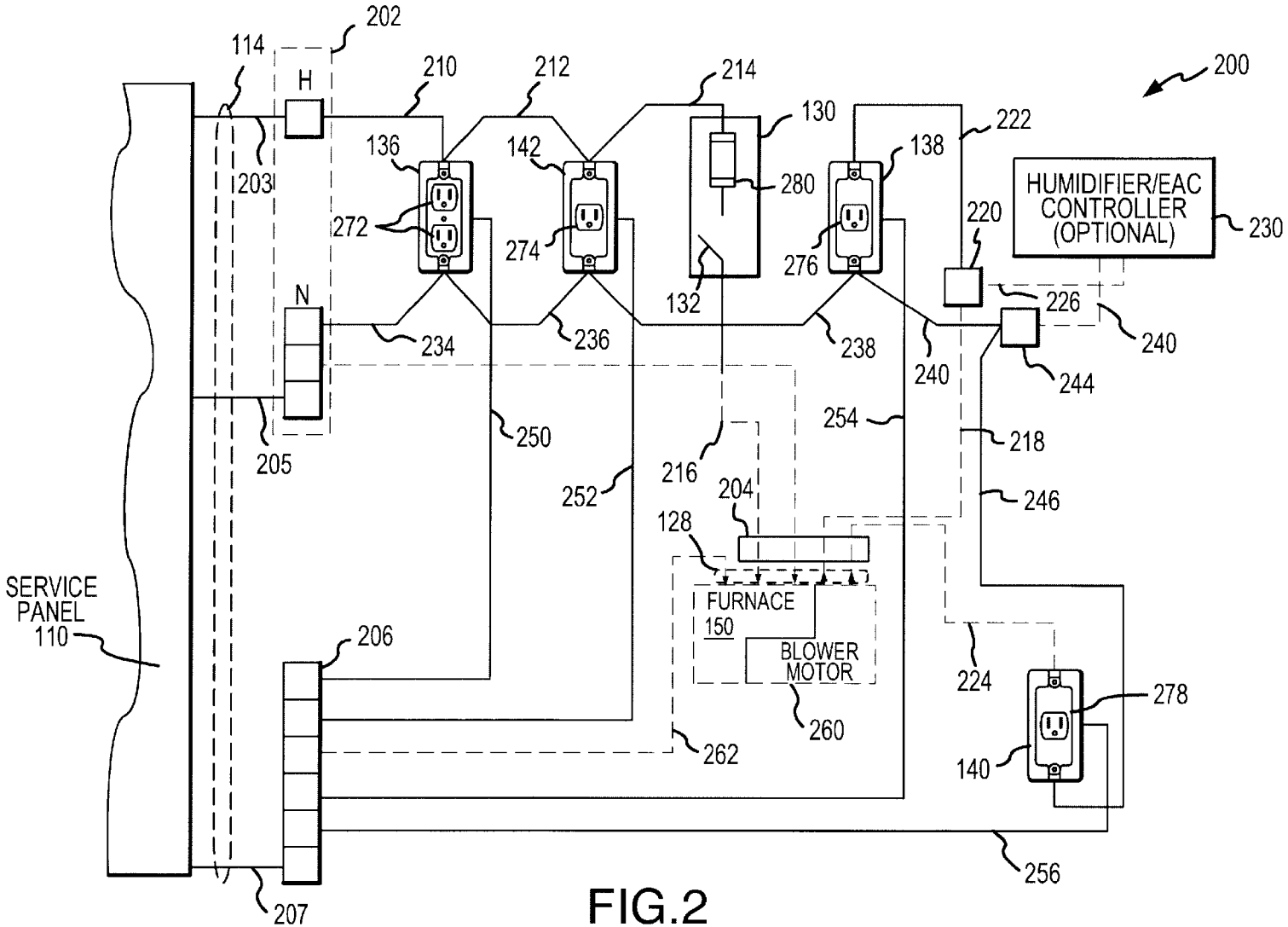
FIG. 2 is a wiring diagram for one embodiment of the furnace junction box of FIG. 1 providing a fixed wiring arrangement for fixed appliance outlets and a GFCI outlet relative to a protective fuse and furnace disconnecting power switch to the furnace blower motor.

The following description begins with a description of an HVAC or furnace system utilizing an all-in-one electrical junction box with descriptions provided on a general or system level with reference to FIG. 1. With reference to FIG. 2, the description then proceeds to one preferred wiring arrangement for the HVAC system of FIG. 1 and to an exemplary circuit used within the all-in-one junction box to ensure compliance with codes and proper operation of the components of the HVAC system. The discussion then turns to one useful physical configuration for the junction box of the invention with reference to FIGS. 3 and 4.

An HVAC or furnace system 100 according to the invention is illustrated in FIG. 1 in block form with an arrangement that is useful in residential buildings using forced-air heating. As shown, the system 100 includes a power source or service panel 110 that typically is a metal box located at a location in a building near the site where electrical power enters the building. In the service panel 110, electrical current is split into individual circuits and typically a circuit breaker or a fuse is provided to protect each circuit. A cable 114 generally including a black or hot wire, a white or neutral wire, and a green or grounding wire is connected to one of these circuits in the service panel 110 and passed through the building to the room containing other components of the system 100, often passing through one or more electrical or junction boxes (not shown). The specific power provided by the service panel 110 may vary to practice the invention and will often vary from country to country. For example, in the United States, the service panel 110 may provide 120V power and 15 or 20 amperes of current while many European countries utilize 240V power. The invention is directed to the more general concept of providing an all-in-one electrical connection box having a pre-established circuit and electrical ports and devices and is useful in nearly any residential electrical system with simple variations in the selected components. Similarly, the particular cable and wire used can vary significantly as long as the cable and wiring is selected to meet national and, if applicable, local codes. In one embodiment, the cable 114 (and other cable in system 100) is nonmetallic (NM) cable with three insulated copper wires (although other conductors can be used and cable 128 typically includes 5 conductors or wires) with a gauge selected to suit the current ratings of the system 100 (such as #14, #12, or lower gauge).

The system 100 includes an all-in-one electrical junction box 120 that is shown mounted to an air return duct 122, e.g., one of the ducts that are typically located near or adjacent the furnace 150. The cable 114 supplies electrical power to the system 100 and is connected to a panel connection 124 in the hook up junction box 120, and as will be seen, the junction box 120 acts as power supply or source for all of the other components in the system 100 rather than requiring separate wiring or branches to each of theses devices with separate boxes being mounted to the duct 122 or elsewhere. In this regard, a cable 128 (typically, a 5-wire cable as shown in FIG. 2) is connected to the furnace or outlet connection 126 in the junction box 120 and is routed to the furnace 150 for connection at the furnace electrical junction box 152. As will become clear with reference to FIG. 2, the cable 128 provides a power supply for the furnace 150 and also provides a control connection between the furnace 150 and the junction box 120 and more particularly, the humidifier outlet 138 and EAC outlet 140.

The junction box 120 includes a humidifier outlet 138 for providing power to a humidifier 156. A power cable or cord 139 is connected to the humidifier 156 at a power connection 158 and is electrically connected to the humidifier outlet 138 to receive power from the service panel 110, and typically, only when appropriate based on operation of the furnace 150 based on a control wire in cable 128 (such as when the blower motor is run). The humidifier 156 is not a required component of the system 100 and is often not initially installed with the furnace 150. The use of a humidifier outlet 138 that is wired to the service panel 110 and the control wires of the furnace electrical junction box 152 allows an upgrade (or replacement of an existing device) to add the humidifier 156 simply by mounting the humidifier 156 as appropriate relative to the furnace 150 and duct 122 and, importantly, to plug the cable 139 into the outlet 138 (i.e., the cable 139 generally will include a standard 3-prong plug).

Similarly, an EAC outlet 140 is provided in the junction box 120 and is wired to the service panel 110 to provide electric power and wired to the control wires of the furnace electrical junction box 152 via cable 128. The system 100 is shown with an EAC 160 installed for cleaning air in duct 122 and has a power cable or cord 141 connected to the power connection 162, i.e., hard-wired to a power cord with a 3-prong plug. If installed (i.e., the EAC 160 is an optional component of system 100), the EAC 160 is powered simply by plugging the cord 141 into EAC outlet 140 and in most configurations, the EAC outlet 140 is only "hot" when the blower motor of furnace 150 is running as controlled by a control wire in cable 128 connected to the furnace connection 126 of junction box 120.

A condensate pump outlet 142 in included in the junction box 120 and is connected to the service panel 110 to provide power to a condensate pump 170. The condensate pump 170 again is an optional component of the HVAC system 100 but when included needs to operate independently of the furnace 150. In this regard, the condensate outlet 142 is wired differently than the humidifier outlet 138 and EAC outlet 140 to be "hot" when the circuit of the panel 110 supplying cable 114 with electricity is not tripped. A power cord or cable 143 is connected to the pump 170 at a power connection 174 (typically, hardwired with a 3-prong plug) and when installed, the cord 143 is inserted into condensate outlet 142 to power the condensate pump 170. According to an important aspect of the invention, each of the outlets 138, 140, and 142 is wired differently as explained above for safety and operational control reasons. Hence, each outlet 138, 140, 142 is labeled for use with a specific fixed appliance 156, 160, or 170 such that wiring of newly added appliances 138, 140, 142 is an easy task that can be accomplished very quickly (i.e., simply plugging in an appliance rather than properly wiring a receptacle box relative to the panel 110 and furnace junction box 152 and its control wires).

To provide overcurrent and/or overload protection, an overcurrent device 130 is provided with a disconnect switch 132. The disconnect switch 132 is wired to be able to disconnect the furnace 150 and associated equipment, such as appliances powered via outlets 138, 140, from the power supply or service panel 110. A number of fuse or overcurrent devices may be used to practice the invention and the specific ampere rating of such devices is selected based on the system 100 and requirements of the furnace 150. In preferred embodiments of the system 100, the device 130 is an UL-approved box cover unit for plug fuses (with a fuse, such as S type fuse, installed) such as an SSU, SSW, SSX, SSY, SSY-RL, or other product available from Bussmann or other electronics companies.

To provide power for tools (such as maintenance or installation tools), the junction box 120 includes a GFCI outlet (such as a single or double receptacle unit) 136 that is wired to the service panel 110. The GFCI outlet 136 is preferably wired in the junction box circuit to be "hot" regardless of operation of the furnace 150 to allow tools to be plugged into the outlet 136 during maintenance on or installation of the furnace 150 and other appliances 156, 160, 170. Typically, this is achieved by wiring the GFCI outlet upstream of the switch 132 and in some cases, upstream of the condensate outlet 142.

Referring to FIG. 2, an exemplary wiring circuit 200 is shown for HVAC systems, such as system 100 of FIG. 1 and like numbers are used in FIG. 2. As shown, the service panel 110 provides power via cable 114 to the junction box circuit with a hot wire 203, a neutral wire 205, and a ground 207 that are connected, respectively, to an incoming power terminal strip or block 202, an outgoing power terminal strip or block 204, and a ground bar 206 all located within the junction box 120. The hot portion of the incoming power terminal strip 202 is connected in turn to the GFCI receptacle 136 by wire (or other conductor) 210, to the condensate outlet 142 by wire 212, and to the fuse and switch device 130 (shown with fuse 280 and switch 132) by wire 214. The neutral portion of the incoming power terminal strip 202 is also connected to the GFCI outlet 136 and the condensate outlet 142 with wires 234, 236, respectively. As shown, the condensate outlet 142 is wired on the line side of the fuse and switch device 130 and the GFCI outlet 136 is wired on the line side of the condensate outlet 142, such that these outlets 136, 142 are hot even when fuse 280 has blown or switch 132 is open (as shown). The outlets 136, 142 are also grounded with conductors 250, 252 connected to ground bar 206. The GFCI outlet 136 may have one or more receptacles 272 (with 2 being shown) and the condensate outlet 142 typically will have only one receptacle 274 to allow a single condensate pump to be plugged into the outlet 142.

The furnace 150 is shown to include a blower motor 260 and is connected to the junction box circuit (and service panel 110 to receive electricity) by 5 wires in cable 128. The 5 wires include a ground 262 connected to the ground bar 206; a neutral wire 263 connected to the outgoing power terminal strip 204; a hot wire 216 connected to the strip 204 from the fused outlet of the switch device 130; a humidifier control wire 218 connected to the strip 204; and a EAC control wire 224 connected to the strip 204. Although shown connected directly to the furnace 150 and blower motor 260 for simplicity, the furnace 150 typically will include an electrical junction box (such as box 152 of FIG. 1) with connections clearly labeled for these five wires including the two control wires 218, 224 which are tied to operation of the blower motor 260 such that these wires 218, 224 are only "hot" when the blower motor 260 is operating.

The control wire 218 is shown connected to node 220 and provides power to the humidifier outlet 138 via line 222. The provision of this power via line 222 may further be controlled by a humidifier controller 230 via signals on line 226, although this is optional and is typically provided via wiring outside the junction box 120 and often separate from the junction box circuit. The humidifier outlet 138 includes a receptacle 276 for receiving a plug from a humidifier power cord. The humidifier outlet 138 is further connected to the neutral portion of incoming power terminal strip 202 via line 238 and to the ground bar 206 via line 254. The control wire 224 provides power to the EAC outlet 140 that includes a receptacle 278 for connecting to a power cord from an EAC. The EAC outlet 140 is connected to ground bar 206 via line 256 and to the neutral portion of the incoming power terminal strip 202 indirectly via line 240, node 244, and line 246. In this regard, the node 244 can be used to control operation of the outlet 140 or power delivery to the outlet 140 (and an EAC plugged into the receptacle 278) via signals on line 240 from EAC controller 230, which is an optional device that is typically not included in the junction box 120 or the junction box circuit. Hence, in some embodiments, the nodes 220 and 244 are not provided in the junction box 120 or its pre-set circuit but can be added later as needed to control power delivery to these outlets 138, 140.

The electrical components and circuitry shown in FIGS. 1 and 2 can be housed in a variety of ways to facilitate the production of a compact and readily mounted junction box (such as box 120). The specific arrangement can be selected to be inexpensive to fabricate by utilizing common parts and components and materials such as typical metals or plastics used for junction boxes and service panels. The junction boxes of the present invention are also preferably configured for ready mounting on or near the furnace 150 such as the return air duct 122 as shown in FIG. 1 or on a wall or stud (not shown). Also, the junction box 120 is preferably adapted to provide easy access to terminal strips and ground bars and to electric receptacles and other components for wiring the junction box and its circuit components to the service panel 110 and furnace 150.

Figure 3:
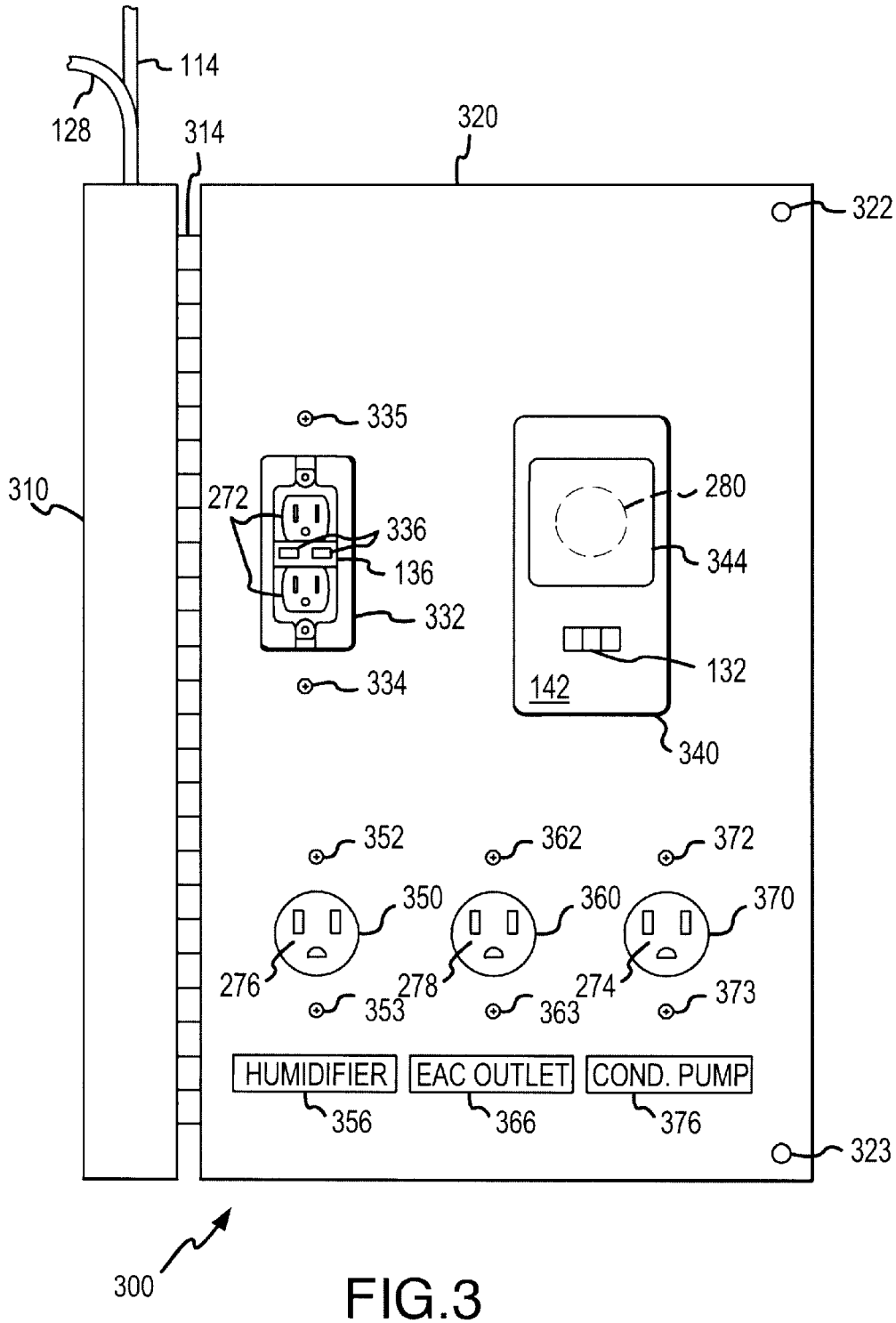
FIG. 3 illustrates one useful physical arrangement of the all-in-one junction box of the invention, such as the junction box of FIG. 1, showing the use of a hinged front door to provide access to internal wiring components and providing external access to fixed appliance receptacles, GFCI receptacles, and a furnace power switch.
Figure 4:
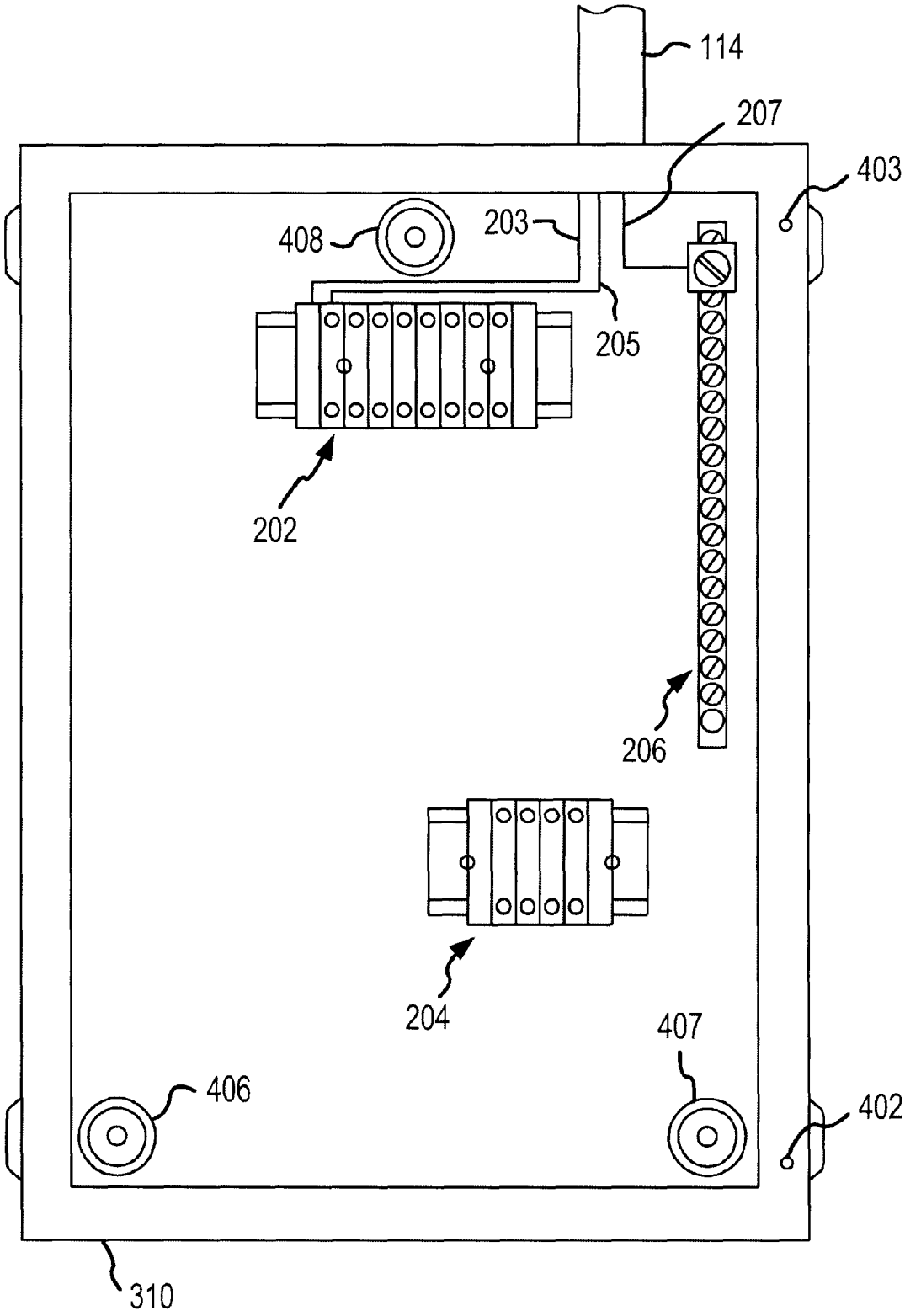
FIG. 4 is a view of the junction box of FIG. 3 with the front panel or door removed showing incoming and outgoing power terminal blocks and ground bar along with wiring connections from a service panel.

One exemplary embodiment of a junction box 300 is shown in FIGS. 3 and 4. As shown, the junction box 300 includes a housing 310 with openings (such as knock outs provided on one or both ends or sides) for passing the cables 114, 128 to and from the service panel 110 and the furnace 150. A door or panel 320 is attached to the housing 310 such as by hinge 314 or fasteners (such as 4 screws provided at each corner and the like) to be removable to provide access to the interior of the housing 310 (and, as such, may simply be a removable panel rather than a hinged door). In embodiments not using a hinge, a chain or other retaining element may be provided to facilitate wiring to be completed between the components in the door 320 and components in the housing 310.

The interior of the housing 310 is shown in FIG. 4 (as the door 320 is removed and the cable 128 is not yet connected). Mounting holes 406, 407, and 408 are provided to allow the housing 310 so that fasteners, such as screws, can be used to mount the housing 310 to a structure including a sheet metal duct. Holes 402 and 403 are provided for securing the door 320 to the housing 310 by fasteners passed through holes 322, 323 in the door 320. To facilitate forming electrical connections (such as the circuit connections shown in FIG. 2), a hot terminal strip 202, a neutral terminal strip 204, and a ground bar 206 are provided in the interior of the housing 310. Although not shown, the terminal strips 202, 204 and ground bar 206 are preferably labeled to indicate connection points for each wire in the junction box circuit (such as each wire in the circuit 200 shown in FIG. 2). The junction box 310 is provided power from the service panel 110 via cable 114 which includes a hot wire 203 that is connected to the incoming power terminal strip 202, a neutral wire 205 that is connected to a neutral portion of the incoming power terminal strip 202, and a ground 207 that is connected to the ground bar 206. The junction box circuit is then completed or wired within the box 310 as shown in FIG. 2.

Referring again to FIG. 3, the GFCI outlet 136 (e.g., a NEMA 5-15R GFCI receptacle or other useful GFCI unit) is shown mounted to the door 320 via fasteners 334, 335 so as to have receptacles 272 and test/reset buttons 336 accessible through opening 332 in the outer surface of the door 320 (with wiring protected behind the door 320 when it is closed). Likewise, the overcurrent and switch device 142 is mounted within the door 320 to be accessible through door opening 340. As shown, an SSU box cover unit is provided for device 142 with a fuse 280 threaded into a socket in the device 142 accessible by opening hinged cover 344 (shown closed) and with a standard switch 132. Three fixed appliance outlets are provided (such as outlets 138, 140, 142 of FIGS. 1 and 2) and are mounted on the door 320 with fasteners 352, 353, 362, 363, 372, 373, such that receptacles 276, 278, and 274 are accessible through receptacle openings 350, 360, and 370, respectively, in door 320. Labels 356, 366, and 376 are provided on the door 320 adjacent the appropriate or associated receptacles 276, 278, 274 to indicate which fixed appliance 156, 160, 170 should be plugged into which receptacle 276, 278, 274 to provide safe and expected operation (i.e., operation of the condensate pump 170 without regard to operation of the furnace 150 and operation of the EAC 160 and humidifier 156 only when the blower motor 260 is operating).

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. For example, the system 100 often will not include the fixed appliances 156, 160, 170 and in some cases, the junction box 120 may not include all of the outlets 136, 138, 140, 142 but instead will include one or more in any useful combination to suit national and local codes and HVAC system configurations of a particular region or country of the world.

I claim:

1. An apparatus for providing an all-in-one electrical hook up unit for a furnace and ancillary appliances, comprising:

means for connecting to a cable from a service panel circuit having hot, neutral, and ground conductors to provide electrical power to the apparatus;

means for connecting to a cable from an electrical junction box of the furnace, the cable including hot, neutral, and ground conductors and control wires for the ancillary appliances;

a circuit coupling the service panel connection means to the furnace junction box connection means to provide the electrical power to the furnace;

an overcurrent and switch unit coupled to a hot portion of the circuit including a disconnect switch allowing manual interruption of the electrical power to the furnace and an overcurrent device operable to interrupt the electrical power to the furnace upon sensing a preset current level;

a ground fault circuit interrupt outlet coupled to the hot portion of the circuit on a service panel side of the overcurrent and switch unit;

an ancillary appliance outlet coupled to the hot portion of the circuit on the service panel side of the overcurrent and switch unit; and a housing supporting and enclosing the service panel connection means, the furnace junction box connection means, the circuit, the overcurrent and switch unit, and the outlets.

2. The apparatus of claim 1, further including an electric air cleaner outlet and a humidifier outlet connected to the circuit on a load side of the overcurrent and switch unit.

3. The apparatus of claim 2, wherein the electric air cleaner outlet and the humidifier outlet have hot connections coupled to the furnace junction box connection means in a manner that connects each of the hot connections to one of the control wires.

4. The apparatus of claim 1, wherein the housing includes a door with openings adapted to provide access to the overcurrent and switch unit and to receptacles of the outlets.

5. The apparatus of claim 1, wherein service panel connection means includes a hot terminal strip for connecting to the hot conductor, a neutral terminal strip for connecting to the neutral conductor, and a ground bar for connecting to the ground conductor.

6. The apparatus of claim 5, wherein the furnace junction box connection means includes the ground bar for connecting to the ground conductor in the furnace cable, the neutral terminal strip for connecting to the neutral conductor in the furnace cable, a connector coupling the hot conductor in the furnace cable to the load side of the overcurrent and switch unit, and connectors coupling the control wires in the furnace cable to hot connections on electric air cleaner and humidifier outlets provided in the apparatus circuit.

7. A furnace and fixed appliance power supply circuit configured for connection to a power source, a furnace, and fixed appliances, comprising:

an electronic air cleaner outlet with a receptacle for coupling with an electronic air cleaner and including hot, neutral, and ground connections;

a humidifier outlet with a receptacle for coupling with a humidifier and including hot, neutral, and ground connections;

a ground terminal strip with terminals for connecting to a ground from the power source, to a ground from the furnace, and to the ground connections on the humidifier outlet and the electronic air cleaner outlet;

conductors connecting the ground connections on the humidifier outlet and the electronic air cleaner outlet to the associated terminals on the ground terminal strip;

a circuit providing power to the furnace including a connector for coupling the furnace power circuit to a hot conductor from the furnace;

a hot terminal strip with terminals for connecting to a hot conductor from the power source and to the furnace power circuit;

a circuit including a connector for coupling with a humidifier control wire from the furnace and a conductor for coupling the connector to the hot connection of the humidifier outlet; and a circuit including a connector for coupling with an electronic air cleaner control wire from the furnace and a conductor for coupling the connector to the hot connection of the electronic air cleaner outlet;

wherein the furnace power circuit includes a overcurrent device and a disconnect switch for protecting the furnace from overload and for selectively interrupting flow of electricity from the hot terminal strip to the furnace; and wherein the furnace power circuit further includes a condensate pump outlet coupled on a line side of the overcurrent device and the disconnect switch.

8. The circuit of claim 7, wherein the furnace power circuit further includes a ground fault circuit interrupt outlet coupled on a line side of the condensate pump outlet.

9. An electrical junction box for use in hooking up a forced-air furnace and associated fixed appliances, comprising:

a panel connection adapted for connecting to a hot wire, a neutral wire, and a ground coupled to an electric power source;

a furnace connection adapted for connecting to a hot wire, a neutral wire, and a ground coupled to an electrical junction box on a forced-air furnace and for connecting to a humidifier control wire and an electronic air cleaner control wire coupled to a humidifier control connection and an electronic air cleaner control connection in the furnace electrical junction box;

a disconnect switch connected in series between the hot wire connection on the panel connection and the hot wire connection on the furnace connection and manually operable to disconnect electricity flow from the electric power source to the furnace;

a ground fault circuit interrupt device including a receptacle connected to the hot wire connection on the panel connection on a line side of the disconnect switch; and a housing with walls for enclosing the panel connection, the furnace connection, the disconnect switch and the ground fault circuit interrupt device.

10. The junction box of claim 9, further including a condensate pump outlet device with a receptacle and connected to the hot wire connection on the panel connection on the line side of the disconnect switch.

11. The junction box of claim 9, further including an electric air cleaner outlet device with a receptacle and coupled to an electronic air cleaner control wire connection of the furnace connection.

12. The junction box of claim 9, further including a humidifier outlet device with a receptacle and coupled to a humidifier control wire connection of the furnace connection.

13. The junction box of claim 9, further including a fuse connected in series between the hot wire connection on the panel connection and the disconnect switch.

* * * * *